US007311039B2

(12) United States Patent
Vuorimies

(10) Patent No.: US 7,311,039 B2
(45) Date of Patent: Dec. 25, 2007

(54) METHOD AND ARRANGEMENT FOR PREVENTING VIBRATIONS IN A MULTI-NIP CALENDER OR CALENDER ARRAY

(75) Inventor: Timo Vuorimies, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/543,525

(22) PCT Filed: Nov. 26, 2004

(86) PCT No.: PCT/FI2004/000720

§ 371 (c)(1),
(2), (4) Date: Jan. 25, 2006

(87) PCT Pub. No.: WO2005/052254

PCT Pub. Date: Jun. 9, 2005

(65) Prior Publication Data

US 2006/0124001 A1 Jun. 15, 2006

(30) Foreign Application Priority Data

Nov. 27, 2003 (FI) ..... 20031735

(51) Int. Cl.
*B30B 13/00* (2006.01)
*B30B 3/04* (2006.01)

(52) U.S. Cl. ..... 100/35; 100/47; 100/161; 100/164; 100/163 A

(58) Field of Classification Search ..... 100/35, 100/41, 43, 47, 161, 163 R, 164, 163 A, 100/162 B, 168, 169, 170, 331

See application file for complete search history.

(56) References Cited

U.S. PATENT DOCUMENTS

| | | | | |
|---|---|---|---|---|
| 3,199,442 | A * | 8/1965 | Kuno et al. | 100/163 R |
| 4,903,517 | A * | 2/1990 | Van Haag et al. | 72/245 |
| 5,961,899 | A | 10/1999 | Rossetti et al. | |
| 6,615,709 | B1 * | 9/2003 | Suomi et al. | 100/41 |
| 6,857,356 | B2 * | 2/2005 | van Haag et al. | 100/35 |

FOREIGN PATENT DOCUMENTS

| | | |
|---|---|---|
| DE | 100 36 574 C1 | 7/2000 |
| EP | 0 779 394 B1 | 6/1997 |
| WO | WO 98/50628 A1 | 11/1998 |
| WO | WO 2005/052254 A1 | 6/2005 |

OTHER PUBLICATIONS

International Search Report issued in PCT/FI2004/000720.
Search Report issued in Finnish Patent Application 20031735.
International Preliminary Report on Patentability issued in PCT/FI2004/000720.

* cited by examiner

*Primary Examiner*—Jimmy T. Nguyen
(74) *Attorney, Agent, or Firm*—Stiennon & Stiennon

(57) ABSTRACT

Vibration is prevented in a multi-nip calender (1) or an array of multi-nip calendars. Each calender has a lower roll (3; 40), an upper roll (3; 30) and two or more intermediate rolls. A fiber web is conveyed through the closed roll nips of the calenders. The intermediate rolls (3) have load-relieving apparatus and the upper roll (3; 30) and the lower roll (3; 40) have loading apparatus, while loading apparatus are connected to the lower roll (3; 40) and/or the upper roll (3; 30) for loading these rolls from the outside in a direction parallel with the calender plane. The running parameters (9) influencing the calendering impulse of one or more selected roll nips (N) are intermittently or continuously changed, such that the overall calendering impulse (9) of the calender or calender array and/or the quality variables (21) of the fiber web remain substantially constant and/or within predetermined limits.

11 Claims, 2 Drawing Sheets

METHOD AND ARRANGEMENT FOR PREVENTING VIBRATIONS IN A MULTI-NIP CALENDER OR CALENDER ARRAY

CROSS REFERENCES TO RELATED APPLICATIONS

This application is a U.S. national stage application of international app. No. PCT/FI2004/000720, filed Nov. 26, 2004, the disclosure of which is incorporated by reference herein, and claims priority on Finnish App. No. 20031735, Filed Nov. 27, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for preventing vibrations in a multi-nip calender, and to an arrangement for preventing vibrations in a multi-nip calender.

The multi-nip calender examined in this invention comprises an upper roll and a lower roll, which are equipped with variable-crown means within the rolls. The upper and/or lower roll can be loaded by external hydraulic cylinders in a direction parallel to plane of the set of rolls, thus generating the desired overall nip pressure and nip pressure distribution in the roll nips of the set of rolls. Two or more intermediate rolls are disposed between the upper and lower roll, in alignment with these. Support arms are attached to bearing houses provided at the ends of the intermediate rolls, the intermediate rolls being articulated from the support arms to the calender frame. Load-relieving means, such as hydraulic cylinders, are connected to the support arms for relieving the weight of the intermediate rolls proper and that of associated auxiliary devices, such as doctor blades, steamer boxes and output rolls.

In a multi-nip calender, there are frequently generated vibrations impairing the calendering result, particularly in cases where the calendering conditions (including nip pressure, moisture of the fiber web, speed of the fiber web) have remained constant over a long period. DE patent specification 10036574 discloses a method for calendering a fiber web in a multi-nip calender with a view to preventing such vibrations generated in a multi-nip set of rolls. The method alters the nip load exerted on a multi-nip calender. Such altered nip load may prevent vibrations in a set of rolls, yet involving the problem of poorer printing characteristics of certain paper grades.

SUMMARY OF THE INVENTION

The purpose of the invention is to eliminate the problems occurring in prior art. Thus, the main objective of the invention is to prevent generation of vibration in a multi-nip calender. A second objective of the invention is to prevent generation of vibrations without substantially altering the printing characteristics of the fiber web.

The method and arrangement of the invention achieve the objectives defined above. The method of the invention for preventing vibrations in a multi-nip calender or multi-nip calender array comprises, in each multi-nip calender, a lower roll, an upper roll and two or more intermediate rolls between the lower roll and the upper roll. The fiber web can be conveyed through the roll nips of two or more multi-nip calenders with the roll nips closed. The intermediate rolls are equipped with load-relieving means and both the upper roll and the lower roll are equipped with loading means within the rolls, and loading means are connected to the lower roll and/or upper roll for loading said rolls from the outside in the direction of the calender plane. In a multi-nip calender or multi-nip calender array, the running parameters acting on the calendering impulse of one or more selected roll nips are modified continuously or periodically, with the overall calendering impulse of a calender or calender array and/or the quality variables of the fiber web remaining substantially constant or within predetermined limits.

The arrangement of the invention, in turn, comprises a control system and a measuring system, the control system comprising a calculation unit and a regulation unit. The regulation unit serves for continuous or periodic changes of the running parameters acting on the calendering impulse of selected one or more roll nips under the control commands from the calculation unit, so that the overall impulse of the calender or calender array and/or the quality variables of the fiber web remain substantially constant or within predetermined limits.

The invention is based on profiling the fiber web in a multi-nip calender by modifying periodically or continuously the profiling conditions and at the same time the calendering impulse in individual roll nips. However, considering a calender or a calender array as a whole, the overall calendering impulse received by the fiber web and the quality variables of the fiber web remain constantly within desired limits. This is achieved with the following procedure: when the running parameters of a calender, such as the support pressure exerted on the support arms by the load-relieving means of the intermediate rolls, the roll temperature etc. are modified into one direction in one roll nip, the same or different running parameters are modified in the inverse direction in a second roll nip, yet without modifying the quality variables in their totality after fiber web calendering in the calender or calender array. In a preferred embodiment of the invention, the nip load is continuously or intermittently modified during the run of individual roll nips, with the overall nip load of a calender or calender array and/or the overall calendering angle remaining within the desired limits.

The notable advantage over known arrangements and methods for alleviating vibrations in multi-nip calenders achieved by the method of the invention is that, while the method prevents efficiently vibrations in a multi-nip calender by modification of the profilation of the fiber web in individual roll nips under varied calendering impulses in each nip, it still does not alter the quality characteristics of the fiber web or the overall calendering impulse received by the fiber web, with a given multi-nip calender or multi-nip calender array considered as a whole.

In this context, a calendering impulse stands for the profilation taking place in the fiber web in the roll nip under consideration, resulting in the desired finish, smoothness and density of the fiber web surface. The overall calendering impulse, in turn, implies the profilation process taking place in the fiber web in the calender or calender array under consideration.

The calendering impulse is influenced by the calender running parameters, consisting i.e. of the calender running speed, the speed of movement of the fiber web in the roll nips of the calender, the nip pressure prevailing in the roll nips, the longitudinal linear pressure profile of the roll, the moisture of the fiber web, the specific properties of the fiber web, etc. The principal calender running parameters relate to the compression and to the compression period of the fiber web, which act on the inherent structure of the fiber web, such as a paper web. The overall compression of the calender depends chiefly on the linear pressure prevailing in the roll nips, on the roll coatings and on the roll diameters. In a multi-nip calender, the overall compression period exerted by the calender on the fiber web, in turn, depends mainly on the nip lengths, the calender running speed and the number of nips, and among these adjustable running parameters, the calender running speed is easiest to use, determining the speed of movement of the fiber web in the roll nips of a multi-nip calender. The surface characteristics of paper, i.e. the finish, can be influenced with the moisture and temperature of the fiber web to be calendered, and also with the linear pressure profile parallel with the roll. The fiber web moisture during running can be varied by regulating the temperature of thermo-rolls and also with the use of web humidification means provided at the ends of the intermediate rolls, such as steamer boxes. Thermo-rolls are frequently provided in a multi-nip calender as alternating intermediate rolls between polymer-coated rolls. The linear pressure profile is controlled in a multi-nip calender by means of loading means within the upper and/or lower roll.

The running parameters of a multi-nip calender defined above can be considered not only for each individual calender or calender array, but also for each roll nip within one calender. In accordance with the invention, the running parameters are varied for each roll nip without, however, altering the actual calendering result (the quality variables of the fiber web and the overall calendering impulse) for each calender or calender array. The particular objective is to maintain the cumulative nip pressure substantially constant in each calender or calender array.

The invention is described in further detail below with reference to the accompanying drawings.

DESCRIPTION OF THE PREFERRED EMBODIMENTS

Figure 1:
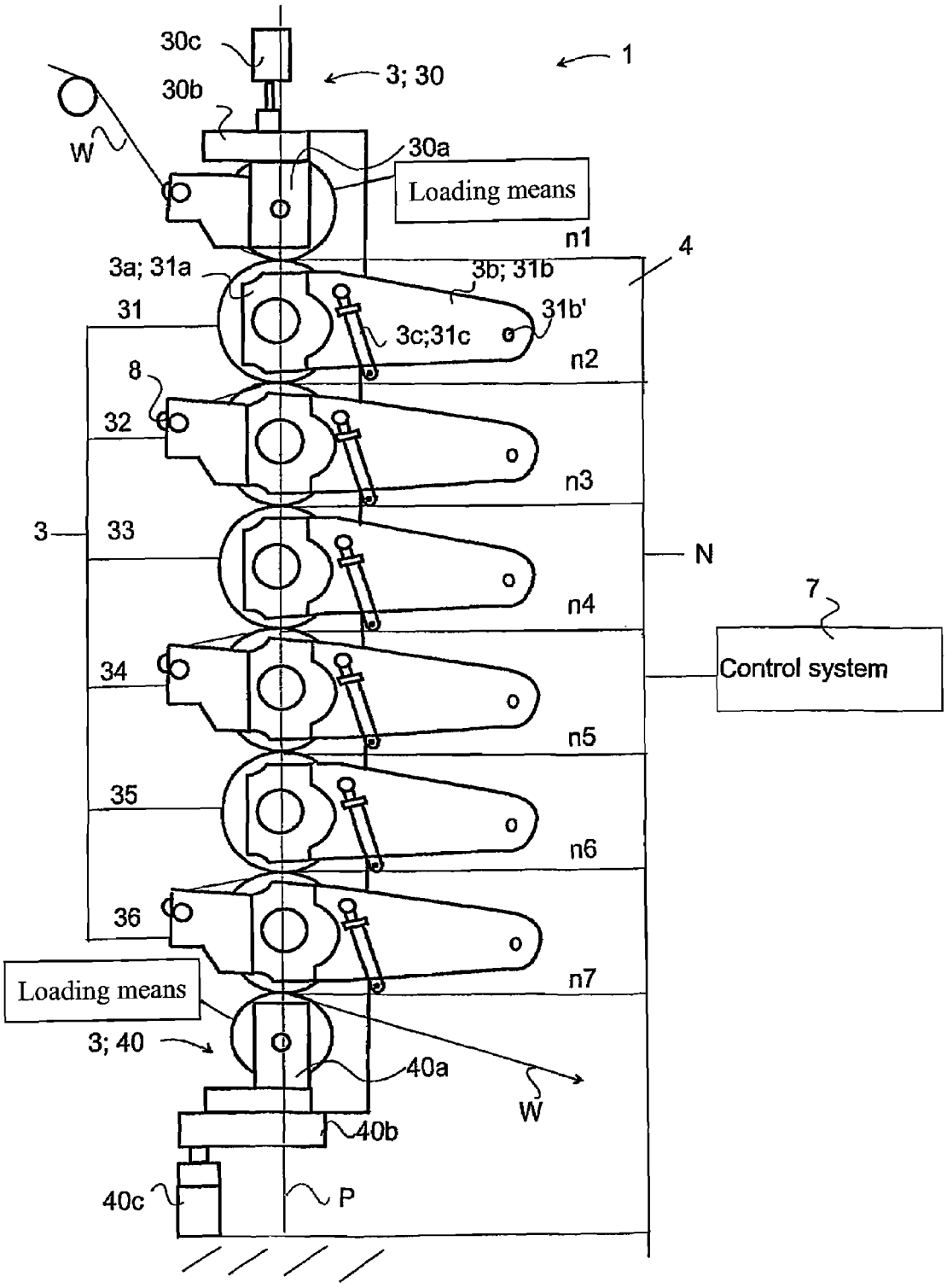
FIG. 1 is a schematic view of the arrangement of the invention applied to a typical multi-nip calender, viewed directly towards the end of the calender.

In the multi-nip calender shown in FIG. 1, the fiber web W enters the calender from above via the guide roll and the output roll, and leaves the calender from the bottom. The calender comprises an upper roll 3; 30, a lower roll 3; 40, and located in the same plane between these, six intermediate rolls 3; 31-3; 36. The upper and lower roll may consist of e.g. heatable thermo-rolls. Among the intermediate rolls, the uppermost roll 31 and the lowermost roll 36 and the two central intermediate rolls 33, 34 are polymer-coated metal rolls, the remaining intermediate rolls 32 and 35 being heatable metal-coated thermo-rolls. Thermo-rolls can be heated either with a fluid, such as water or oil, introduced into the rolls, underneath their mantle, or when higher temperatures are desired, by using external induction heating of the mantle. The design of thermo-rolls and polymer-coated rolls is conventional per se. Between the central intermediate rolls (polymer-coated rolls 33, 34), the calender comprises a "reverse roll" for control of one-sidedness of the paper. The calender comprises a control system 7 for controlling the calendering of a paper web in a multi-nip calender 1 and for reducing vibrations in the calender in accordance with the method of the invention.

The plane P passing through the upper and the lower roll and the intermediate rolls is called the plane of the set of rolls. The set of rolls has a substantially vertical plane. The design of the load-compensating means of the upper intermediate roll 31 is examined below. The load-compensating means of the remaining intermediate rolls have a similar design. The ends of the intermediate roll 3; 31 are fitted rotatably into their bearing houses 3*a*; 31*a* and support arms 3*b*; 31*b* are connected to these bearing houses by articulation to the frame at their articulation 31*b*'. Load-compensating means 3*c*; 31*c*, such as hydraulic cylinders, have been attached to the support arms 3*b*; 31*c* for raising and lowering the support arms 3*b*; 31*c*. Output rolls 8 have been connected to the bearing houses 3*a* of the intermediate rolls for taking the fiber web W from one roll nip to another in the multi-nip calender 1.

The upper roll 3; 30 and lower roll 3; 40 of the calender 1 are equipped with loading elements within said rolls for desired compensation of the deflection of the roll mantles. The loading elements provided within the rolls have a conventional design per se; the loading elements may consist e.g. of cylinder arrays, which can be controlled zone-wise by opening and closing liquid ducts leading to cylinders underneath the roll mantle in the roll nip. In a preferred embodiment, three longitudinal rows of hydraulic cylinders are provided within the rolls. The axes of the upper roll 3; 30 and the lower roll 3; 40 are disposed rotatably with their ends fitted in respective bearing housings 30*a* and 40*a*, and these bearing housings 30*a* and 40*a* are articulated over related loading arms 30*b* and 40*b* in the frame 4 of the calender 1. The upper roll and lower roll can be accordingly loaded parallel to the plane P of the set of rolls by loading means 30*c* and 40*c*, such as external hydraulic cylinders, attached above and underneath the rolls. The uppermost roll 3; 30 can be pressed downwardly by means of loading means 30; 30*c*, with the roll moving vertically downwardly, and the lowermost roll 3; 40, in turn, can be lifted upwards with loading means 40; 40*c*, and then the roll rises vertically upwards. When the lowermost roll is lifted upwardly and/or the uppermost rolls is pressed downwardly, the roll nips N; n1, n2, n3, n4, n5 n6, n7 between the rolls in a set of rolls, or at least some of them, close, while the desired nip pressure is generated in the roll nips N. The longitudinal nip pressure distribution (linear pressure distribution of the roll nips) is controlled with loading means provided within the upper roll 3; 30 and the lower roll 3; 40 (not shown in the figure).

Each intermediate roll 3; 31, 32, 33, 34, 35, 36 is subjected not only to the loading pressure exerted by the upper and/or lower roll 3; 30, 40, but also to the weight of auxiliary means, such as doctor blades, steamer boxes (not shown in the figures) fixed to bearing houses 3*a* provided at the ends of said intermediate rolls, and also to that of output rolls 8. The weight of the auxiliary means and of the rolls proper acting over the bearing housings on the ends of these rolls can be compensated completely or partly with hydraulic cylinders 3*c* fixed to support arms 3*b* connected to the bearing housings 3*a* of the intermediate rolls 3; 31-3; 36. Depending on the load relief of each intermediate roll 3, 31-3;36 and on the loading pressure of the upper and lower roll 3; 40, 30, the linear (overall) loading angle of the calender 1 can be altered as desired.

Figure 2:
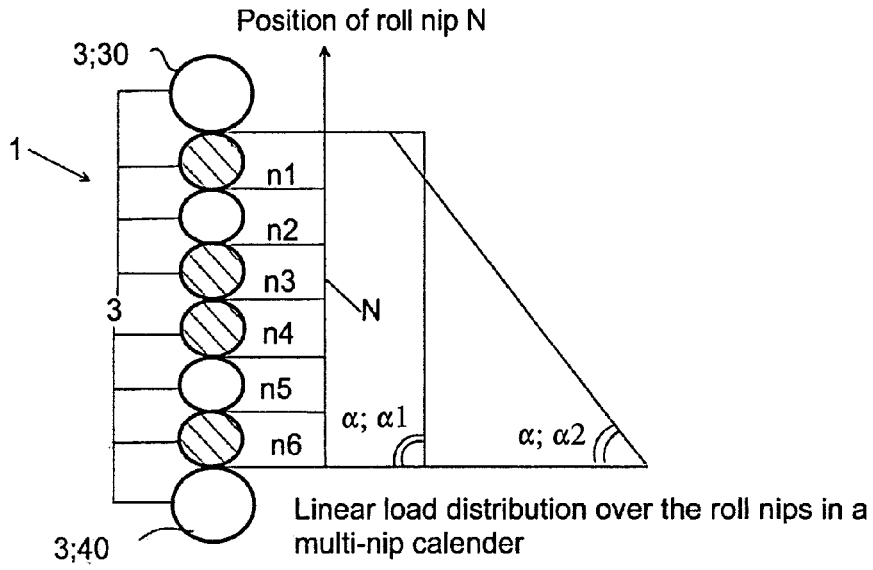
FIG. 2 is a simplified view of the multi-nip calender of FIG. 1 with its nip pressure distribution shown for each nip.

FIG. 2 illustrates the linear loading angle of a multi-nip calender in a calender of FIG. 1. The figure shows the multi-nip calender of FIG. 1 in a simplified form. The figure exemplifies the distribution of a linear load generated with two different loading angles α; α1 and α; α2 between the roll nips N; n1 to n7.

The loading angle α illustrates the overall nip load of the calender and the distribution of the overall nip load over the individual roll nips N. The nip forces prevailing in the roll nips N; n1 . . . n7 are adjusted so that the difference between the nip forces of the uppermost roll 3; 30 (upper roll) and the lowermost roll 3; 40 (lower roll) is at a given level in the calender, implying adjustment of the loading angle α. The linear overall load of the calender depends on the base load of the calender 1, i.e. on the weight of the intermediate rolls 3; 31-3; 36 proper and that of the related auxiliary means and on the additional load generated by the upper roll and the lower roll. In a preferred case, the weight exerted by each intermediate roll 3; 31-3; 36 and the auxiliary means connected to its ends (cf. FIG. 1) has been compensated so that the remaining weight causing the crown of this particular intermediate roll generates equal deflection in each roll. This allows calculation of the nip load of each intermediate roll by means of the characteristics of the intermediate roll, the roll deflection and the pressure exerted on the roll. The overall nip load of the calender is the sum of the nip loads of these rolls. Defining, calculating and performing the linear loading angle are operations known per se, and thus WO patent application FI98/00392 is cited with respect to these.

The nip load can be calculated separately for each roll nip N; n1 . . . n7 after the desired load angle α of the calender has been calculated. The nip load on the roll nip is calculated on the linear load angle α of the calender using the calculating means and calculating methods described in the WO patent application mentioned above. The linear load angle can be altered using the calculating means and calculating methods described in the WO patent application mentioned above, and so is the distribution of the (overall) load angle between the individual roll nips n1 to n7. Thus, in the multi-nip calender illustrated in FIG. 2, comprising six intermediate rolls 3; 3-13;36, a lower roll 3; 40 and an upper roll 3; 30, the load angle a can be selected relatively freely, provided that the control and calculation methods described in the WO patent application above are used. Subsequently, the load angle determines the degree to which the load-compensating means 3*c* of the intermediate rolls 3 compensate for the weight of each intermediate roll and the related auxiliary means. In FIG. 2, the load angle a is 90 degrees, compensating fully for the weight of each intermediate roll 3; 31-3; 36 proper and for that of the auxiliary means. The load angle α, α2 is in the range 75-80 degrees. With the load angle a defined in terms of the desired calendering result, the nip pressure prevailing in each roll nip N; n1 to n7 can be calculated and/or measured on the basis of this load angle. In case the nip pressure of say, an individual roll nip n1 to n7 is subsequently altered in order to prevent generation of vibrations in the multi-nip calender, the calculation formulas disclosed in the WO patent application above allows determination of the degree to which the nip pressures prevailing in one or more roll nips and the running parameters acting on the nip pressures (in this case the support forces exerted by the load-compensating means 3*c* on the support arms 3*b*) need to be changed for compensating the previous changes, so that the overall nip pressure prevailing in the calender 1 and the load angle a remain constant or at least within predetermined limits.

Figure 3:
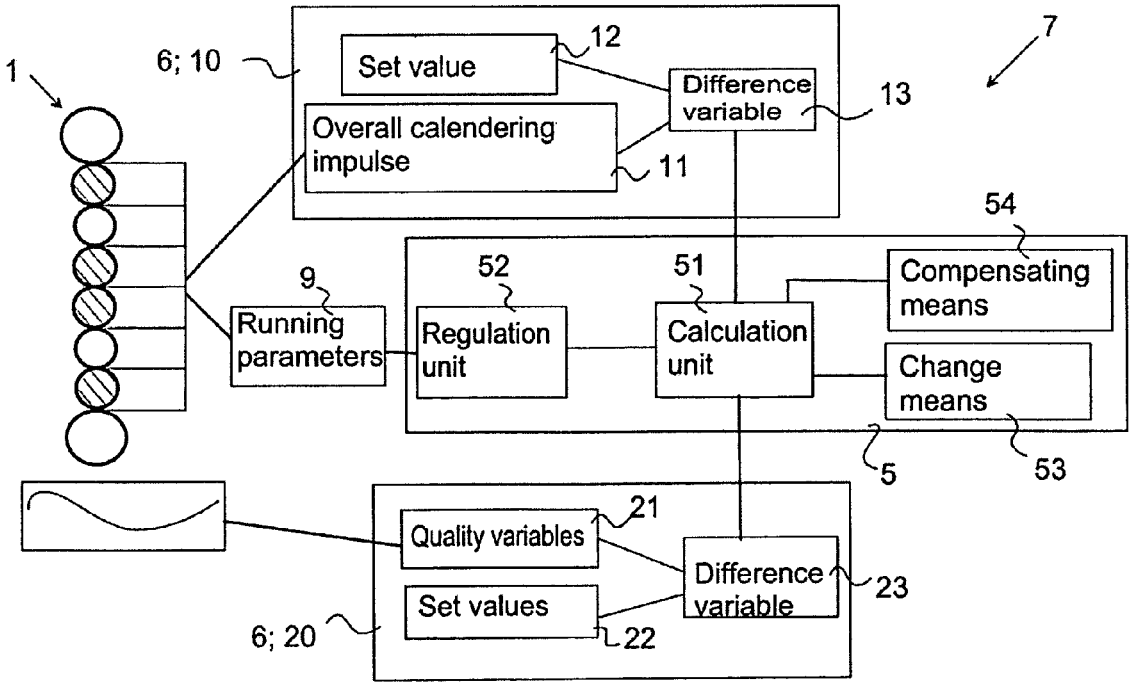
FIG. 3 shows the control system used in the arrangement of the invention in the form of a block diagram.

FIG. 3 illustrates how to prevent vibrations in a multi-nip calender 1 of FIG. 1 using the method of the invention and maintaining the overall calendering impulse 11 and/or the quality variables 21 of the fiber web constant in the calendering impulse measurement block 6; 10. The overall calendering impulse 11 measures the overall impact of selected running parameters 9 on a fiber web to be calendered in the roll nips of a multi-nip calender. The quality variables 21, in turn, serve to measure the change of different characteristics of the fiber web in the course of calendering. Such quality variables 21 consist e.g. of the finish, smoothness and density of the paper web, and they are acted on with different calender running parameters, which have been discussed above. The remaining running parameters 9 acting on the overall impulse are then assumedly constant. A change in the overall calendering impulse 11 can also be evaluated e.g. in a case where the impact of a running parameter 9 on the overall calendering impulse 11 is predictable with sufficient reliability. Unless the overall calendering impulse 11 is actually measured, the controls are usually checked by measurements of the quality variables.

The aim is to keep the running parameters 9 selected in the method of the invention for acting on the overall calendering impulse 11 constant by comparing the value of the overall calendering impulse 11 evaluated or determined on the measured running parameters 9 with a predetermined set value 12 for the overall calendering impulse 11 and by keeping the difference variable 13 between the overall calendering impulse 11 and its set value 12 thus obtained at a minimum value (close to zero). Instead of the overall calendering impulse 11, one could also monitor only some partial variables of the overall calendering impulse 11, such as the overall pressure prevailing in the roll nips (cf. FIG. 2). In that case, one could measure e.g. only the overall nip pressure of the calender explained in conjunction with FIG. 2. Among the running parameters 9 acting on the overall nip pressure, the principal parameters are the loading pressure on the upper and/or lower roll and the weight of the auxiliary means connected to the intermediate rolls to be compensated with the load-compensating means 3*c* of the intermediate rolls 3; 31-3;36. It is simultaneously possible to change also the running parameters 9 acting on the calendering impulse of individual roll nips periodically or intermittently using a selected change means 53 and a calculation unit 51. The predicted change of the overall calendering impulse 11 caused by the changes of the running parameters 9 can be taken into account by calculatory means in the calculation unit, it can be evaluated or calculated on the basis of a suitable predetermined difference variable 13 between the compensation function and/or the overall impulse used as compensation means 54. The calculation unit 51 calculates, on the basis of the change function used as change means 53, the compensation function 54 and/or difference variable 13 of the overall calendering impulse 11 (or a partial variable of this), the changes to be carried out in the running parameters 9 of appropriate roll nips, by means of which it is intended to compensate the changes of the same or different running parameters 9 in the other roll nips, in order to prevent generation of vibrations in a multi-nip calender.

In addition to or instead of the overall calendering impulse 11 or its partial variables mentioned above, it is also possible to monitor the changes of selected quality variables 21 of a fiber web, such as a paper web, and to perform compensation of the running parameters 9 entirely or partly on the basis of predicted (evaluated) and/or measured changes of the quality variables. Carrying out periodic or intermittent changes of the first running parameters 9, which act on the calendering impulse and/or the quality variables in the first roll nips and prevent vibrations in a multi-nip calender 1, involves measurement or evaluation of the influence of such changes on the quality variables of the fiber web, such as the smoothness and density of the paper web on the calender level. This is followed by changes of the other running parameters 9, whose influence on the calendering impulse and/or the quality variables of the fiber web in the other roll nips compensates for the changes caused by the first running parameters in the calendering impulse and/or quality variables of the first roll nips. The changes to be made in the other roll nips are evaluated on the basis of quality variables 21 of the fiber web as measured or predicted after the calender.

FIG. 3 illustrates how quality variables are taken into account in the method of the invention with a block 6; 20 for measuring quality variables. Depending on the selected intermittent or continuous manner of changing, changes are made over the regulation unit 52 to the first running parameters 9, which change the calendering impulse received by the fiber web in the first roll nips and thus reduce the vibration susceptibility of the multi-nip calender. After this, or simultaneously with this, the calculation unit 51 calculates the changes of the second running parameters compensating for the changes of the first running parameters, the changes of the second running parameters being made over the regulation unit 52 in the selected manner of adjustment in the second roll nips. Then the quality variables 21 of the fiber web, such as finish and thickness, are measured after the calender (frequently both before and after the calender). These measured quality variables 21 of the fiber web are compared with their set values 22, and on the basis of the differences variables 23 obtained from the quality variables, the accuracy of the changes of the running parameters is checked through the calculation unit 51, and any additional changes are made to the first and/or second running parameters 9.

As a variant of the manner of controlling a multi-nip calender 1 described above, changing the running parameters 9, such as the nip pressure, in specific roll nips, prevents vibrations in a multi-nip calender. These changes of the running parameters 9 are compensated merely on the basis of changes of the quality variables 21 measured in the fiber web W; if the measured values of the quality variables 21 of the fiber web do not show any substantial differences from the set values 22 of these quality variables, there will be no need for compensating for changes of the running parameters 9 with a view to prevent vibrations. If, however, the difference variable 23 between the measured values 21 and the set values 22 grows too much due to changes of the running parameters 9, the changes are compensated, as described above, by means of the calculation unit 51 and the regulation unit 52.

If, instead of changes of the overall calendering impulse 11, changes of the overall nip pressure are measured and evaluated as described above in connection with FIG. 2, one seeks to keep the load angle $\alpha$ constant as described in connection with FIG. 2. When it is desirable to prevent vibrations in a multi-nip calender by changing the nip pressure in one or more roll nips N under a given change function 54 (e.g. by alternating changing the pressure of each roll nip at given intervals), the running parameters 9 required for generating the changes of the nip pressures in the roll nips are calculated in the calculating unit 51. The practical operation involves calculating the degree to which the pressure exerted by the hydraulic cylinders 3*c* on the support arm(s) 3*b* of first intermediate rolls should be altered in order to achieve the desired changes of the nip pressure. In addition, the calculation unit calculates, on the basis of a compensating means 54, such as a compensation function or formula, the degree to which the nip pressure and thus also the pressure exerted by the hydraulic cylinders 3*c* on the support arms 3*b* of the intermediate rolls 3 needs to be changed in one or more second roll nips for the overall nip pressure and the calendering angle $\alpha$ to remain at the desired values.

Only a number of embodiments of the invention have been described above, and it is obvious to those skilled in the art that the invention can be implemented in many other ways as well without departing from the inventive idea defined in the claims.

Thus, the method for preventing vibrations in a multi-nip calender as described with respect to one single multi-nip calender above can be extended to an array of several multi-nip calenders, which is controlled by a control system for preventing vibrations similar to the one described above. Changes are then monitored at the level of the calender array; when the running parameters of individual roll nips of a calender are changed in order to prevent vibrations, the compensating changes of the running parameters can be performed in the same calender or in a different one, with the overall calendering impulse and/or the quality variables of the fiber web remaining at the desired values in the calender array under consideration.

The invention claimed is:

1. A method for preventing vibrations in a multi-nip calender or an array of multi-nip calenders, wherein each multi-nip calender comprises:

a lower roll;

an upper roll; and two or more intermediate rolls between the lower roll and the upper roll, the rolls defining a plurality of roll nips, wherein a plane is defined passing through the upper roll, the lower roll, and the intermediate rolls, a direction being defined lying in said plane; and wherein a fiber web is conveyed through the plurality of roll nips of the multi-nip calender or array of multi-nip calenders with the roll nips closed, the intermediate rolls being equipped with load-relieving means and the upper roll and the lower roll being equipped with first loading means within said upper roll and lower roll and second loading means being connected to the lower roll and/or the upper roll for loading said rolls towards the intermediate rolls in the direction of the plane of the calender, wherein running parameters are applied to each of the plurality of closed roll nips to apply a calendering impulse to the web, and wherein the entire multi-nip calender or array of multi-nip calenders applies an overall calendering impulse to the web to produce a web which leaves the multi-nip calender or array of multi-nip calenders with certain quality variables;

the method comprising:

continuously or intermittently changing the running parameters acting on the calendering impulse of one or more selected roll nips of the plurality of closed roll nips so that the overall calendering impulse of the calender or calender array and/or the quality variables of the fiber web remain substantially constant and/or within predetermined limits.

2. The method of claim 1, wherein the step of changing the running parameters acting on the calendering impulse of one or more selected roll nips comprises changing the running parameters acting on nip pressure of the selected roll nips/roll nip so that an overall nip pressure of the multi-nip calender or calender array remains within predetermined limits or constant.

3. The method of claim 2, wherein the nip pressure of individual roll nips is changed so that a calendering angle of the multi-nip calender remains within predetermined limits.

4. The method of claim 3, wherein the upper roll applies a pressure on the intermediate rolls, and wherein the lower roll applies a pressure on the intermediate rolls, such that there is a pressure difference, and wherein the calendering angle is maintained at a desired value by keeping the pressure difference exerted by the upper and lower roll on the intermediate rolls of the multi-nip calender at a desired value.

5. The method of claim 1 wherein the step of changing the running parameters acting on the calendering impulse of one or more selected roll nips comprises changing continuously or intermittently selected running parameters acting on the calendering impulse of one or more first roll nips in a multi-nip calender or multi-nip calender array, and further comprising the steps of measuring or evaluating the overall calendering impulse of the calender or calender array or its partial variables and/or of selected quality variables of the fiber web; and changing the running parameters acting on the calendering impulse of one or more second roll nips so that the overall calendering impulse and/or the quality variables of the fiber web remain substantially constant.

6. The method of claim 5, wherein the method comprises changing the running parameters by changing the nip pressure of one or more roll nips and measuring the changes of the overall calendering impulse by determining the changes of the overall nip pressure of the calender or calender array.

7. An arrangement for preventing vibrations in a multi-nip calender or an array of multi-nip calenders, each multi-nip calender comprising a lower roll, an upper roll and one or more intermediate rolls between the lower roll and the upper roll, wherein a plane is defined passing through the upper roll, the lower roll, and the intermediate rolls, a direction being defined lying in said plane, a fiber web being conveyable through two or more roll nips of the multi-nip calender with the roll nips closed, the intermediate rolls being equipped with load-relieving means and the upper roll and the lower roll being equipped with first loading means within said upper roll and lower roll and second loading means being connected to the lower roll and/or upper roll, respectively, for loading the rolls towards the intermediate rolls in the direction of the plane of the calender, wherein running parameters are applied to each of said two or more closed roll nips to apply a calendering impulse to the web, and wherein the entire multi-nip calender or array of multi-nip calenders applies an overall calendering impulse to the web to produce a web which leaves the multi-nip calender or array of multi-nip calenders with certain quality variables; the arrangement comprising:

a measurement system;

a control system, which comprises a calculation unit which issues control commands and a regulation unit, the regulation unit allowing continuous or intermittent changes of running parameters acting on the calendering impulse of one or more roll nips of said two or more closed roll nips on the basis of the control commands from the calculation unit, so that the overall calendering impulse of the calender or calender array and/or the quality variables of the fiber web remain substantially constant or within predetermined limits.

8. The arrangement of claim 7 wherein:

the calculation unit of the control system determines changes of the running parameters to be made in each roll nip on the basis of data delivered from a change means, a compensating means and the measurement system;

the regulation unit of the control system regulates the running parameters of the multi-nip calender or calender array on the basis of information received from the calculation unit and values of the running parameters; and the measurement system comprises means for receiving information about the overall calendering impulse of the calender or calender array and/or the quality variables of the fiber web.

9. A method for preventing vibrations in a calendering apparatus having at least one multi-nip calender, each multi-nip calender having:

a lower roll, an upper roll, two or more intermediate rolls between the lower roll and the upper roll, wherein a plane is defined passing through the upper roll, the lower roll, and the intermediate rolls, a direction being defined lying in said plane, and wherein a plurality of closed roll nips are defined between the rolls, and wherein the intermediate rolls have load-relieving means, and the upper roll and the lower roll have loading means for loading said rolls towards the intermediate rolls in the direction of the plane of the calender, the method comprising:

passing a web through each of the plurality of closed roll nips of the calendering apparatus to calender the web;

applying running parameters to each of the plurality of closed roll nips to apply a calendering impulse to the web, and wherein the calendering apparatus applies an overall calendering impulse to the web to produce a web which leaves the calendering apparatus with certain quality variables; and continuously or intermittently changing the running parameters acting on the calendering impulse of one or more selected roll nips of the plurality of roll nips so that the overall calendering impulse of the calender or calender array and/or the quality variables of the fiber web remain substantially constant and/or within predetermined limits.

10. A method for preventing vibrations in a calendering apparatus having at least one multi-nip calender, each multi-nip calender having:

a lower roll, an upper roll, two or more intermediate rolls between the lower roll and the upper roll, wherein a plane is defined passing through the upper roll, the lower roll, and the intermediate rolls, and wherein a plurality of closed nips are defined between the rolls, and wherein the intermediate rolls have load-relieving means, and the upper roll and the lower roll have loading means for loading said rolls towards the intermediate rolls in the plane of the calender, the method comprising:

passing a web through each of the plurality of closed nips of the calendering apparatus to calender the web, the calendered web leaving the calendering apparatus at a position downstream of the calendering apparatus, all positions on the web downstream of the calendering apparatus being after the calendering apparatus;

applying running parameters to each of the plurality of closed nips to apply a calendering impulse to the web, and wherein the calendering apparatus applies an overall calendering impulse to the web to produce a web which leaves the calendering apparatus with certain quality variables; and intermittently or continuously changing first running parameters of first roll nips of said plurality of closed roll nips to change the calendering impulse received by the web in the first roll nips and thus reduce the vibration susceptibility of the calender;

after or simultaneously with changing said first running parameters, calculating changes of second running parameters to compensate for the changes of the first running parameters, and changing the running parameters of second roll nips of said plurality of closed roll nips to be the second running parameters; and measuring the quality variables of the web after the calendering apparatus, checking the accuracy of the changes of the running parameters through a calculation unit, and making additional changes to the first and/or second running parameters.

11. The method of claim 10 wherein the quality variables measured after the calendering apparatus include finish and thickness.

* * * * *

UNITED STATES PATENT AND TRADEMARK OFFICE

CERTIFICATE OF CORRECTION

PATENT NO. : 7,311,039 B2
APPLICATION NO. : 10/543525
DATED : December 25, 2007
INVENTOR(S) : Timo Vuorimies It is certified that error appears in the above-identified patent and that said Letters Patent is hereby corrected as shown below:

In column 5, line 43 of the issue patent "load angle a" should be --load angle α--

In column 5, line 49 of the issue patent "load angle a" should be --load angle α--

In column 5, line 53 of the issue patent "angle a" should be --angle α--

In column 5, line 66 of the issue patent "load angle a" should be --load angle α--

Signed and Sealed this

Tenth Day of June, 2008

JON W. DUDAS
*Director of the United States Patent and Trademark Office*